United States Patent [19]

Diehl et al.

[11] Patent Number: 4,668,420

[45] Date of Patent: May 26, 1987

[54] DETERGENT BUILDER

[75] Inventors: Manfred Diehl, Frankfurt; Roland Bergmann, Grosskrotzenburg, both of Fed. Rep. of Germany

[73] Assignee: Degussa Aktiengesellschaft, Frankfurt, Fed. Rep. of Germany

[21] Appl. No.: 820,353

[22] Filed: Jan. 21, 1986

[30] Foreign Application Priority Data

Feb. 9, 1985 [DE] Fed. Rep. of Germany ..... 3504451

[51] Int. Cl.[4] ..... C11D 17/06

[52] U.S. Cl. ..... 252/135; 252/140; 252/174.17; 252/174.21; 252/174.25; 252/527; 252/546

[58] Field of Search ..... 252/135, 140, 174.17, 252/174.21, 174.25, 527, 546, DIG. 15

[56] References Cited

U.S. PATENT DOCUMENTS

| | | | |
|---|---|---|---|
| 3,985,669 | 10/1976 | Krummel et al. | 252/140 |
| 4,096,081 | 6/1978 | Phenicie et al. | 252/89 R |
| 4,184,975 | 1/1980 | Krings et al. | 252/140 |
| 4,215,007 | 7/1980 | Krings et al. | 252/174.25 |
| 4,414,130 | 11/1983 | Cheng | 252/140 |

FOREIGN PATENT DOCUMENTS 1429143 3/1976 United Kingdom .

*Primary Examiner*—Paul Lieberman
*Assistant Examiner*—Hoa Van Le
*Attorney, Agent, or Firm*—Beveridge, DeGrandi & Weilacher

[57] ABSTRACT

A granulated detergent builder is disclosed comprising:

65 to 85 weight percent of a water insoluble silicate capable of binding calcium, in the form of a finely dispersed, bound-water-containing, synthetically produced, water insoluble crystalline compound having the general formula:

$$(Cat_{2/n}O)_x.Me_2O_3.(SiO_2)_y \quad (I),$$

in which Cat is a cation exchangeable with calcium with the valency n, x is a number from 0.7 to 1.5, Me is boron or aluminum, and y a number from 0.8 to 6, 4 to 10 weight percent sodium nitrilotriacetate 1.5 to 3 weight percent nonionic surfactant 0 to 1 weight percent alkali 0.5 to 1.5 weight percent carboxymethyl cellulose and/or methylcellulose and the balance is water.

The product can be produced by spray drying an aqueous suspension in which all ingredients are dispersed or dissolved.

7 Claims, No Drawings

DETERGENT BUILDER

Powdery Type A Zeolite, which can be used as a phosphate substitute in detergents, is a lumpy powder that tends to agglomerate because of its small particle size. It is difficult to combine this zeolite powder with other detergent ingredients into a homogeneous powder. This is aggravated by the fact that the final mixture has a tendency to separate.

To avoid this mixing problem, zeolite granulated compounds are added to the previously spray dried detergent ingredients. These zeolite granulated compounds are produced, inter alia, by spray drying an aqueous suspension of the zeolite powder with the addition of other detergent ingredients.

It has been previously suggested to produce and to add zeolite granulated compounds to the other detergent ingredients (cf. West German patent application Ser. No. 31 20 744, British Patent No. 1,429,143). These known zeolite granulated compounds have the disadvantage that they do not meet the standards set for them. Thus, it is necessary that the zeolite granulated compound have an undiminished calcium-binding capacity, a good redispersing ability, and good transport and particle stability. As low a dust content as possible is of particular importance.

Accordingly, the invention has as its object the provision of a granulated detergent builder, comprising:

65 to 85 weight percent of a water insoluble silicate capable of binding calcium, in the form of a finely dispersed, bound-water-containing, synthetically produced, water insoluble, crystalline compound having the general formula:

$$(Cat_{2/n}O)_x \cdot Me_2O_3 \cdot (SiO_2)_y \quad (I)$$

in which Cat is a cation exchangeable with calcium with the valency n, x a number from 0.7 to 1.5, Me is boron or aluminum, and y a number from 0.8 to 6, 4 to 10 weight percent sodium nitrilotriacetate 1.5 to 3 weight percent nonionic surfactant up to 1 weight percent alkali 0.5 to 1.5 weight percent carboxymethylcellulose and/or methylcellulose and the balance being water.

According to the detergent builder of the invention, the component set forth in formula (I) can be crystalline.

Preferably, an aluminosilicate can be used as the component according to formula (I). In formula (I), y stands for a number 1.3 to 4. In a preferred embodiment, the crystalline component according to formula (I) can be a Type A zeolite.

According to the invention, the aluminosilicates set forth in formula (I) can be naturally occurring or synthetically manufactured products, the synthetically manufactured products being preferred. As an example, the production can be carried out by reaction of water soluble silicates with water soluble aluminates in the presence of water. To accomplish this, aqueous solutions of the starting materials can be mixed together, or one component in solid form can be reacted with the other component present as an aqueous solution. The desired aluminosilicates are also obtained by mixing the two components present as solids in the presence of water. Aluminosilicates can be also be produced from $Al(OH)_2$, $Al_2O_3$ or $SiO_2$ by reaction with alkalisilicate or alkali aluminate solutions. Other known methods can also be used for their production. More particularly, the invention relates especially to aluminosilicates with a threedimensional space lattice structure.

The preferred calcium binding capacity, which is approximately in the range of 100 to 200 mg of CaO/g of aluminosilicate and generally approximately 100 to 180 mg of CaO/g of aluminosilicate, is found mainly in compounds with the composition:

$$0.7-1.1\ Na_2O \cdot Al_2O_3 \cdot 1.3-3.3\ SiO_2$$

This empirical formula comprises two types of different crystal structures (or their noncrystalline initial products), which also differ in their empirical formulas. These are as follows:

$$0.7-1.1\ Na_2O \cdot Al_2O_3 \cdot 1.3-2.4\ SiO_2 \quad (1)$$

$$0.7-1.1\ Na_2O \cdot Al_2O_3 \cdot 2.4-3.3\ SiO_2 \quad (2)$$

These different crystal structures are evident in the X-ray diffraction pattern.

The crystalline aluminosilicate as an aqueous suspension can be separated from the remaining aqueous solution by filtration and dried. Depending on drying conditions, the product contains more or less bound water. The aluminosilicates, however, after their production, need not be dried at all to prepare the detergent builders according to the invention. On the contrary—and this is particularly advantageous—an aluminosilicate can be used when still wet from production.

The particle size of individual aluminosilicate particles can vary and be say, in the 0.1 micron to 0.1 mm range. This specification refers to the size of primary particles; i.e., the size of the particles formed during precipitation and, possibly, during the subsequent crystallization. It is especially advantageous to use aluminosilicates at least 80 weight percent of which consists of particles ranging from 10 to 0.01 micrometers, preferably from 8 to 0.1 micrometers, in size.

Preferably, aluminosilicates do not contain primary or secondary particles with diameters greater than 45 micrometers. Secondary particles are particles formed by agglomeration of the primary particles into larger structures.

In view of the agglomeration of the primary particles into larger structures, the use of the aluminosilicates still wet from their production proved quite successful in producing the detergent builder recording to the invention, since it appeared that the formation of secondary particles is almost totally prevented by the use of this still wet product.

In an especially preferred embodiment of the invention, powdery Type A zeolite with a specifically defined particle spectrum is used as component A.

This type of zeolite powder is known in the art and according to West German patent specifications Nos. 24 27 021 and 25 17 218 and West German patent application Nos. 26 52 419; 26 51 420; 26 41 436; 26 51 437; 26 51 445; or 26 51 485, all relied on and incorporated by reference. They are characterized by the particle distribution curves given therein.

In an especially preferred embodiment of the invention, a powdery Type A zeolite can be used having the particle size distribution described in West German patent application No. 26 51 485, relied on and incorporated by reference.

Addition products of 4 to 40, preferably 4 to 20, mol of ethylene oxide per mol of fatty alcohol, alkyl phenol, fatty acid, fatty amine, fatty acid amide, or alkane sulfonamide can be used as nonionic surfactants. Especially important are the addition products 5–16 mol of ethylene oxide to coco or tallow alcohols, to oleyl alcohol, or to secondary alcohols with 8–18 carbons, preferably 12–18 carbons, as well as to mono- or dialkyl phenols with 6–14 carbons in the alkyl groups. Of particular interest is the addition product of 5 mol of ethylene oxide to tallow alcohol. In addition to these water soluble nonionic surfactants, however, water insoluble or not totally water soluble polyglycol ethers with 1–4 ethylene glycol ether groups in the molecule are also of interest, especially if they are used in combination with water soluble nonionic or anionic surfactants.

Also suitable as nonionic surfactants are water soluble addition products, containing 20–250 ethylene glycol ether groups and 10–100 propylene glycol ether groups, of ethylene oxide to polypropylene glycol, alkylene diamine polypropylene glycol, and alkylpolypropylene glycol with 1–10 C atoms in the alkyl chain, in which the polypropylene glycol chain functions as a hydrophobic group.

Nonionic surfactants such as amine oxides or sulfoxides are also suitable.

Of particular interest for use as the nonionic surfactant is a mixture of at least two different fatty alcohol ethoxylates based on isotridecyl alcohol or an aliphatic $C_{13}$-alcohol and ethylene oxide. A mixture of fatty alcohol ethoxylate with 4.5 to 5.5 ethylene oxide and fatty alcohol ethoxylate with 6 to 8 ethylene oxide is preferable.

Furthermore, a mixture of at least two different alkyl phenol ethoxylates with the formula:

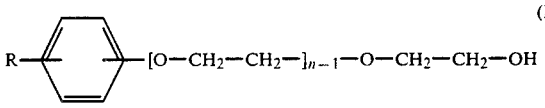

$$R-C_6H_4-[O-CH_2-CH_2-]_{n-1}-O-CH_2-CH_2-OH \quad (II)$$

can be used as the nonionic surfactant.

Here, R can be an aliphatic group with 1 to 15 C atoms, e.g., $-CH_3$, $-C_2H_5$, propyl, butyl, pentyl, hexyl-, heptyl-, octyl-, and nonyl, preferably with 9 C atoms such as nonyl. The R groups can be substituted at the ortho, meta, or/and para position. Mixtures can also be used in which an o-substituted benzene ring is present in addition to the p-substituted aryl ring. Mixtures are used in which up to 90% is p-substituted and up to 10% is orthosubstituted.

In the mixture of the alkyl phenol ethoxylates employed, n can be 2 to 7, preferably 4 to 6, especially 5, and for the other alkyl phenol ethoxylates 8 to 15, preferably 8 to 12, especially 9 or 10. In alkyl phenolate mixtures, however, n may also be 7 or 9 or 12.

Each of the alkyl phenol ethoxylates and the isotridecyl ethoxylates can be used in any mixture, preferably in a 1:9 to 9:1, preferably 2:3 to 3:2, particularly 0.9:1 to 1.1:0.9 ratio. In this case, the alkyl phenol ethoxylates correspond to the formula in which R=nonyl and n=5 or 9.

As will be apparent from the above, any suitable nonionic surface active agent may be used.

NaOH and/or KOH can be used as the alkali. Other suitable alkaline materials may also be used as desired. Some alkaline material must be present and therefore, the impression "up to 1" weight percent is used to exclude 0% alkali. The lower limit is not narrowly critical.

The zeolite granulated compound embodying the invention has an extremely high adsorptive capacity for water, for example. It itself is not hygroscopic, although it contains the sodium salt of nitrilotriacetic acid, which is hygroscopic.

Therefore, the novel granulated detergent builder can be combined advantageously with the other detergent ingredients without subsequent separation. In this way, considerable energy expenditures that would be necessary if the production of the complete detergent were to be effected with spray drying to remove a large proportion of water are avoided. Accordingly, any suitable detergent ingredients may be used with the novel granulated detergent builder of this invention provided such use does not adversely effect the builder.

The detergent thus obtained is free of phosphates.

The following examples serve to illustrate the present invention without being limiting thereof.

EXAMPLES

A zeolite A filter cake is prepared according to West German application No. 26 51 485. The powdery Type A zeolite obtained has the particle spectrum indicated therein.

The zeolite A filter cake is agitated by a dissolver and heated in a 50-liter vessel to 45° C. Then the nonionic surfactant is mixed in for 15 minutes at 75–76 rpm with an MIG agitator, during which the temperature of the slurry rises to 50° C.

The following substances are used as nonionic surfactants:

1. isotridecyl alcohol ethoxylate 5 mol ethylene oxide;
2. isotridecyl alcohol ethoxylate 6.75 mol ethylene oxide;
3. nonyl phenol ethoxylate 5 ethylene oxide;
4. nonyl phenol ethoxylate 9 ethylene oxide; and
5. tallow alcohol ethoxylate 5 ethylene oxide.

The resulting suspension is combined with the other ingredients listed in the tables and then spray dried (jet dryer inlet temperature 180° C., outlet temperature 75° C.).

The results are presented in the following Table 1:

TABLE 1

| Example | 1 | 2 | 3 | 4 | 5 | 6 |
|---|---|---|---|---|---|---|
| Zeolite 4A | 71.2 | 74 | 70.4 | 70.4 | 70.4 | 70.4 |
| Tallow alcohol 5 EO | — | — | 2.35 | 2.35 | — | — |
| Isotridecyl alcohol 5 EO | — | — | — | — | 1.2 | — |
| Isotridecyl alcohol 6.5 EO | — | — | — | — | 1.2 | — |
| Nonyl phenol 5 EO | — | — | — | — | — | 1.2 |
| Nonyl phenol 9 EO | — | — | — | — | — | 1.2 |
| *NTA $Na_3$ | 8 | 8 | 8 | 8 | 8 | 8 |
| Sodium carbonate | — | 5.0 | — | — | — | — |
| NaOH | — | 0.65 | 0.45 | 0.45 | 0.4 | 0.4 |
| CMC/MC | — | — | — | 1.0 | 1.0 | 1.0 |
| Water | 20.8 | 15.95 | 18.8 | 17.8 | 17.8 | 17.8 |
| Bulk density | 565 | 570 | 540 | 530 | 510 | 515 |
| Particle distribution | | | | | | |
| 1.6 mm % | 0 | 0 | 0 | 0 | 0 | 0 |
| 0.8 mm % | 0 | 0 | 1 | 1 | 2 | 1 |
| 0.4 mm % | 0 | 0 | 22 | 25 | 24 | 25 |
| 0.2 mm % | 32 | 21 | 56 | 55 | 56 | 55 |
| 0.1 mm % | 55 | 61 | 18 | 17 | 16 | 18 |
| <0.1 mm % | 13 | 18 | 3 | 2 | 2 | 1 |
| Dust test according | 0.37 | 0.23 | 0.15 | 0.07 | 0.06 | 0.07 |

TABLE 1-continued

| Example | 1 | 2 | 3 | 4 | 5 | 6 |
|---|---|---|---|---|---|---|
| to Groschopp | | | | | | |

(EO denotes ethylene oxide)
*sodium nitrilotriacetate

The dust test according to Dr. Groschopp listed in Table 1 is performed as follows:

The powder falling into a cylinder via a chute is collected in a tank placed below the chute location, while the dust particles settle outside this tank on the bottom plate of the cylinder and can be determined gravimetrically. The following equipment is used:

Equipment to estimate the dust originating from the chute
- Manufacturer: AEG, type DR 50
- 220 V, 50 Hz, 0.15 A Outer cylinder
- Height: 70 cm, diameter 40 cm
- closed at the top, open at the bottom
- The top plate has a circular opening (diameter: 3 cm) in the center for locating the filling pipe).

Inner cylinder
- Height: 10 cm, average 18 cm
- closed at the bottom, open at the top.

Bottom plate
- Shape: round
- Diameter: 48 cm

Filling pipe
- Length: 30 cm, diameter: 2.5 cm
- Depth of immersion of the pipe into the outer cylinder: 20 cm The immersion depth is maintained constant by means of a brass washer soldered to the outside wall of the filling pipe (diameter 15 cm, thickness 1 mm).

Hopper:
- Top diameter: 15 cm
- Outlet diameter: 1.8 cm
- Length of stem: 8 cm

The dust content is given as a precentage of the initial weight.

CONVEYANCE TESTS

The test product is transported from a charging hopper via a 7.0 m long flexible screw conveyor with a 4 m rise into an empty container. In order to simulate a longer delivery track, the material to be transported is conveyed once again through the screw conveyor.

The built in vibratory apparatus was not required as a discharge means in the charging hopper, since the product according to Example 4, above all, has excellent inherent flow properties.

This is apparent from Table 2 in which the results of the conveyance tests with products according to Examples 3 and 4 are compared.

TABLE 2

| | Bulk density g/liter | Waste heap mm | Flowability* grade | Comment |
|---|---|---|---|---|
| Test product according to Example 3 | | | | |
| Before conveyance | 500 | 23 | 2 | |
| After conveyance | 515 | 39 | 6 | screw conveyor clogged |
| Test product according to Example 5 | | | | |
| Before conveyance | 500 | 15 | 1 | |
| Conveyed 1× | 510 | 19 | 1 | |
| Conveyed 2× | 515 | 21 | 1 | |

| SPECIFICATION OF THE CONVEYOR SYSTEM | |
|---|---|
| Type | BI-FO BF 40/D1 |
| Length | 7 m |
| Height | 4 m |
| Screw conveyor | NW 40 |
| Determined output | 840 kg/h |

*described in the serial publication, Pigments of Degussa AG, No. 50, Evaluation with use of the school grading system (1 = very good, 6 = unsatisfactory), page 11.

SUCTION LIFTING (VACUUM PUMP SYSTEM A20)

The test product is drawn in from a charging hopper via a 10 m delivery track, NW 50, into a material collector and captured in an empty container. Entrained air is continually drawn in by means of a hand operated throttle. Therefore, this did not result in the formation of a plug, but in the slow deposit of flue dust.

TABLE 3

| | Bulk density g/liter | Waste heap mm | Flowability* grade | Comment |
|---|---|---|---|---|
| Test product according to Example 3 | | | | |
| Before conveyance | 500 | 23 | 2 | |
| After conveyance | 400 | 49 | 6 | |
| Test product according to Example 4 | | | | |
| Before conveyance | 500 | 15 | 1 | |
| Conveyed 1× | 500 | 15 | 1–2 | |
| Conveyed 2× | 515 | 16 | 2 | |

| SPECIFICATION OF THE CONVEYOR SYSTEM | |
|---|---|
| Delivery line | 10 m, NW 50 |
| Life | 6 m |
| Vacuum pump | Type V 63, 63 m3/h |
| Power | 1.5 kW |
| Measured vacuum | 2500 mm water column |
| Pumping rate | 500–750 kg/h |
| Collector | Type A 50 |

The mechanical conveyance produced good results only with the test product according to Example 4, whereas the product according to Example 3 resulted in obstructions in the screw conveyor due to cakings.

The extremely good adsorptive capacity of the product of the invention is apparent from the following table:

The product according to Example 4 is used, during which the water absorption is measured. Water is sprayed onto the product in a gravity mixer.

| Sample No. | % $H_2O$ | Flowability (fresh) | Flowability (after 24 h) | |
|---|---|---|---|---|
| 1 | — | 1 | 1 | no caking |
| 2 | 4 | 1 | 1–2 | no caking |
| 3 | 8 | 1 | 2 | no caking |
| 4 | 12 | 2 | 2–3 | no caking |
| 5 | 16 | 2 | 2–3 | no caking |
| 6 | 20 | 2 | 2–3 | no caking |
| 7 | 24 | 2–3 | 3 | some caking |
| 8 | 28 | 2–3 | 3 | some caking |
| 9 | 32 | 3 | 3 | some caking |

-continued

| Sample No. | % $H_2O$ | Flowability (fresh) | Flowability (after 24 h) |
|---|---|---|---|
| 10 | 36 | 6 | |

Grades:
1 = very good/6 = no longer flowable

The determination of flowability is described in the publication series, Pigments of Degussa AG, No. 50, page 11.

Further variations and modifications of the invention will be apparent from the foregoing and are intended to be encompassed by the claims appended hereto.

The German application No. P 35 04 451.9 is relied on and incorporated by reference.

We claim:

1. A granulated detergent builder is disclosed consisting of:

65 to 80 weight percent of a water insoluble silicate capable of binding calcium, in the form of a finely dispersed, bound-water-containing, synthetically produced, water insoluble crystalline compound having the general formula:

$$(Cat_{2/n}O)_x \cdot Me_2O_3 \cdot (SiO_2)_y$$

in which Cat is a cation exchangeable with calcium with the valency n, x is a number from 0.7 to 1.5, Me is boron or aluminum, and y a number from 0.8 to 6, 4 to 10 weight percent sodium nitrilotriacetate, 1.5 to 3 weight percent nonionic surfactant, 0 to 1 weight percent alkali, 0.5 to 1.5 weight percent carboxymethyl cellulose and/or methylcellulose, and the balance is water.

2. The granulated detergent builder according to claim 1 wherein said crystalline compound is an aluminosilicate.

3. The granulated detergent builder according to claim 1 wherein y is 1.3 to 4.

4. The granulated detergent builder according to claim 1 wherein the crystalline compound is a Type A zeolite.

5. The granulated detergent builder according to claim 2 wherein the aluminosilicate has the empirical formula:

$$0.7-1.1\ Na_2O \cdot Al_2O_3 \cdot 1.3-3.3\ SiO_2.$$

6. The granulated detergent builder according to claim 2 wherein the aluminosilicate has at least 80% particles ranging in size from 10 to 0.01 micrometers.

7. A phosphate-free detergent composition containing the granulated detergent builder as set forth in claim 1.

* * * * *